United States Patent [19]

Hayashi

[11] Patent Number: 4,652,810

[45] Date of Patent: Mar. 24, 1987

[54] SUBMINIATURE CURRENT TRANSFORMER

[75] Inventor: Eiji Hayashi, Tokyo, Japan

[73] Assignee: Yokogawa Hokushin Electric Corporation, Tokyo, Japan

[21] Appl. No.: 815,989

[22] Filed: Jan. 3, 1986

[30] Foreign Application Priority Data

Jan. 29, 1985 [JP] Japan ..... 60-14727
Jan. 29, 1985 [JP] Japan ..... 60-14728

[51] Int. Cl.[4] ..... H01F 40/06
[52] U.S. Cl. ..... 323/357; 324/127
[58] Field of Search ..... 323/356–358; 336/173, 184–185, 199, 208; 324/123 R, 127

[56] References Cited

U.S. PATENT DOCUMENTS 2,644,135 6/1953 Schnoll ..... 324/127 X
3,813,574 5/1974 Sato ..... 336/185 X
3,815,013 6/1974 Milkovic ..... 323/357
3,881,149 4/1975 Kiko ..... 323/356

*Primary Examiner*—Peter S. Wong
*Attorney, Agent, or Firm*—Moonray Kojima

[57] ABSTRACT

In conventional subminiature current transformers, voltage withstandability property is not reliable and frequency characteristics are inferior. The current transformer of the invention, advantageously, is able to withstand high voltages and also has other advantageous characteristics. A primary coil and a secondary coil are wound about individual bobbins disposed on two L-shaped legs connected together to form a square "O" shaped core. Compensation for various errors is accomplished by a condenser and a resistor connected between the input and output terminals of an operational amplifier (of the integrated circuit type) which is connected to the output of the secondary coil. The primary and secondary core areas are selectively controlled as to the currents applied to enable the transformer to withstand the high voltages.

3 Claims, 10 Drawing Figures

SUBMINIATURE CURRENT TRANSFORMER

BACKGROUND OF THE INVENTION

1. Field of Invention.

This invention relates to a subminiature current transformer which is capable of withstanding high voltages and which includes a frequency compensating device.

2. Description of the Prior Art.

A current transformer is used when it is desired to introduce electrical signals from a commercial power line into an analog IC (integrated circuit). Since such a current transformer is normally used together with the analog IC, both are usually attached to the same circuit board. It is desirable to have the combined structure as small as possible.

The Japanese Industrial Standard(JIS), for example, requires that such current transformers have a capacity to withstand high voltages on the primary side, for example, of 3000 volts AC for one minute, and 4500 impluse volts for $1\times40$ μsec. Other industrial standards, such as the ANSI, similarly requires such current transformers to have the capacity to withstand high voltages.

As shown in FIG. 1, the conventional current transformer is configured to have its primary coil N1 and secondary coil N2 wound about a single bobbin B, in an overlapped manner. To handle the high voltages required by such standards, an insulating layer S, together with a shield, are provided between the primary and secondary coils. However, disadvantageously, in such current transformers having the insulating sheet, it is impossible to provide sufficient creepage distance between the primary and secondary coils. Thus, the more the current transformer is reduced in size, so as to fit the IC input, the more difficult it becomes to satisfy the high withstanding voltage standards. Accordingly, in the art, the conventional current transformers are inevitably large sized, that is not within the subminiature size range.

If the conventional current transformer is reduced in size to the subminiature range, the frequency characteristic, as well as the capacity to withstand high voltages, are degraded. This is because core loss increases with increase in degree of miniaturization, and there results in a characteristic having a "corner" in the frequency range which is higher than the commercial frequency.

Thus, there is a need in the art for a subminiature current transformer which can meet the industrial standards regarding capacity to withstand high voltages e.g. at the primary windings, and which has the other advantageous characteristics of being relatively error free.

SUMMARY OF THE INVENTION

Accordingly, an object of the invention is to overcome the aforementioned and other disadvantages and deficiencies of the prior art.

Another object is to provide a subminiature current transformer which is able to withstand high voltages, of the order specified by the usual industrial standards, and which also incorporates an IC as a direct load.

A further object is to provide a subminiature current transformer whose precision is enhanced by reducing its self loss.

A still further object is to provide a subminiature current transformer equipped with a device for compensating for relative error and for phase angle error, over a wide frequency range.

A yet further object is to provide a subminiature current transformer which introduces an electrical signal from a power line directly into an analog IC thereby to permit precise measurements.

DESCRIPTION OF PREFERRED EMBODIMENTS

Figure 2:
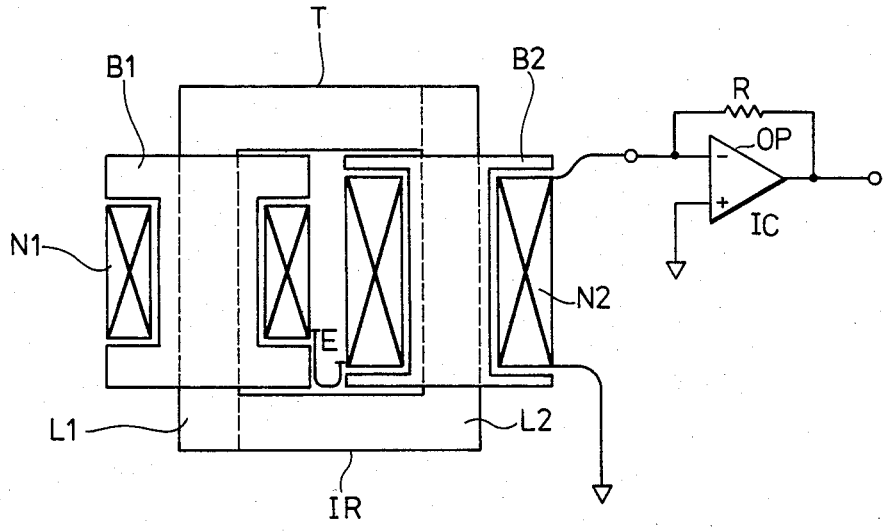
FIG. 2 depicts an illustrative embodiment of the invention.

The illustrative current transformer of the invention, as depicted in FIG. 2, for example, comprises a current transformer T comprising a rectangular "O" shaped core IR which comprises two L-shaped legs of laminated core segments assembled, such as by physically attaching together, into the shape of a hollow rectangle or square, as depicted. Individual bobbins B1 and B2, which differ in shape, such as size, from each other are disposed on each of the two L-shaped legs, such as bobbin B1 on leg L1 and bobbin B2 on leg L2. A primary coil N1 is wound about bobbin B1. A secondary coil N2 is wound about bobbin B2. The L-shaped legs and bobbins are made of magnetic material. The coils may be wound directly onto the legs L1,L2, as later described.

In order to attain a current transformer which can withstand high voltages, such as of the order recommended by the usual industrial standards, the creepage distance (length indicated by E in FIG. 2) between the primary side bobbin B1 and secondary side bobbin B2, is selected to be sufficiently large. In case the primary current is large, the primary coil N1 may comprise a thick wire, such as of copper, and of suitable diameter to carry the large current, which wire is caused to pass through or is wound directly about leg L1 of core IR, without use of bobbin B1. For example, in case the primary current is 5 Amps and the primary coil N1 is designed so as to give 5 AT (ampere-turns), the primary coil N1 is wound one turn. If 10 AT is desired, two turns are formed about leg L1.

The absolute value of the primary side loss in the current transformer T does not matter with regard to the characteristics of the current transformer. The primary side is selected with respect to coil material and wire size so that coil N1 can bear (i.e. carry) the amount of current which is allowable in the transformer. From the foregoing point of view, the core area of primary coil N1 (which includes also the area of bobbin B1, if bobbin B1 is used) in current transformer T shown in FIG. 2, is a space whose allowable current limit, as represented in terms of AT (ampere-turns), is very small. Thus, the primary side section of the transformer of the invention is made very small.

Returning to FIG. 2, analog integrated circuit IC is connected to the secondary winding N2 of transformer T and comprises an operational amplifier OP and a resistor R connected between the (−) input end and output terminal of amplifier OP. The input (+) end of amplifier OP is grounded. Secondary coil N2 is connected at one end to the (−) input end of amplifier OP and at the other end to ground. The analog IC serves as a direct load of the current transformer T.

In a current transformer which incorporates an analog IC as its direct load, it is possible to regard a secondary load as substantially zero. Thus, for example, in FIG. 2, the self loss of current transformer T is produced only by the winding resistance of secondary coil N2. Accordingly, the smaller the coil resistance of coil N2, the smaller the self loss. As occasion demands, in place of the analog IC a resistor may be connected as the secondary side resistor which has a value substantially smaller than the coil resistance of secondary coil N2. The description herein refers to the term "large" and "small" and variations thereof. These are dimension terms to be taken in context of the subminiature nature of the invention, as would be evident to the worker in the art. Exemplary overall dimensions are shown below and these terms are to be applied in such context.

Although the self loss of a miniature current transformer generally increases with increase in the secondary load, according to the invention, which takes into account the size of the secondary coil N2, as described above, and incorporates the IC as the direct load, there is realized a current transformer which is miniaturized and has substantially no self loss. Furthermore, according to the invention, a novel double "L" core configuration is used, wherein two L-shaped core segments L1,L2 are attached together to form core IR. Thus, there is realized a current transformer having a very small self loss. Accordingly, the invention realizes a subminiature, very high precision current transformer.

In the current transformer of the invention, which incorporates an IC as a direct load, the summing point (SP) of the operational amplifier OP is kept at ground potential. Thus, no voltage withstandability criteria is required between secondary coil N2 and core IR.

Figure 1:
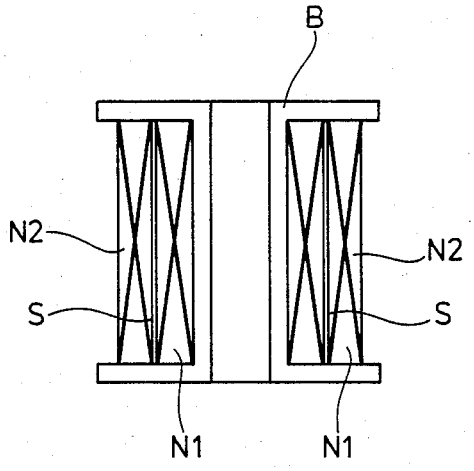
FIG. 1 (PRIOR ART)
FIG. 1 is a elevational view of a conventional current transformer.

A comparison was made of the conventional current transformer of FIG. 1 and the invention, as depicted in FIG. 2, with the following results.

| | Conventional | Invention |
|---|---|---|
| Conversion Precision | ±0.1% | ±0.1% |
| Primary AT (ampere-turns) | 30 AT | 5 AT |
| Primary Current | 5 Amp | 5 Amp |
| Secondary Winding | 6,000 turns | 4,000 turns |
| Secondary current | 5 mA | 1.25 mA |
| Primary-Secondary voltage | 2,600 VAC | 3,000 VAC |
| withstandability | (1 min.) | (1 min.) |
| Core weight | 70 g | 11 g* |
| Overall size | 24 × 44 × 25 mm = 29.7 $cm^3$ | 16 × 21 × 12.5 mm = 4.2 $cm^3$ |
| Secondary Load | Resistance Load** | IC direct type |

Notes:
* = (inclusive of mounting parts)
** = (after converted into voltage, this is introduced into the IC)

Figure 3:
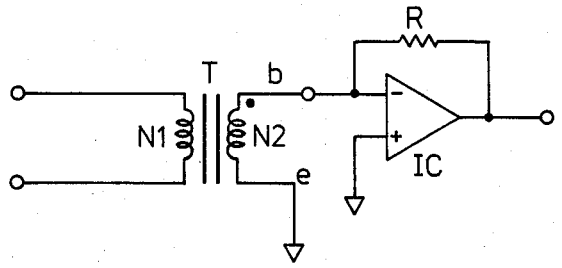
FIG. 3 is a circuit diagram of the embodiment of FIG. 2.

Although in the prior current transformer of FIG. 1, a shield S is included to prevent interference from appearing between the primary coils and the secondary coils, according to the invention, which incorporates the IC as a direct load, as shown in FIG. 3, the beginning b of secondary coil N2 is connected to the (−) input end of the IC and the end e of coil N2 is grounded. Thus, a shield, such as required in the prior art, can be omitted. As is apparent from the foregoing, in the current transformer T shown in FIG. 2, primary coil N1 and secondary coil N2 are configured so as to achieve their respective objects. That is, the coil area of the primary coil side, whose loss does not directly influence the characteristics, is made small, and the coil area of the secondary coil side, to which the IC or like, is connected and whose loss causes a problem, is made so as to have a large an area as possible. Thus, there is realized a subminiature current transformer which can withstand high voltages and which has an IC as a direct load.

In general, among the losses suffered by the current transformer, core loss is the major loss. This core loss is represented by a resistance component R being in parallel with an excitation inductance L in the equivalent circuit.

In case the current transformer is made to be small, as described above, its core loss component would tend to increase and a corner frequency represented by $2\pi L/R$ takes a larger value with the miniaturization. When the device is made to be subminiature, the core loss becomes extremely high. In such case, it is possible to compensate for the frequency by making the phase of the primary current agree with that of the secondary current. However, in such a case, the absolute value of the core loss varies largely depending upon the frequency. Thus, the frequency characteristic cannot be compensated for completely by the use of such tactics.

Figure 4A:
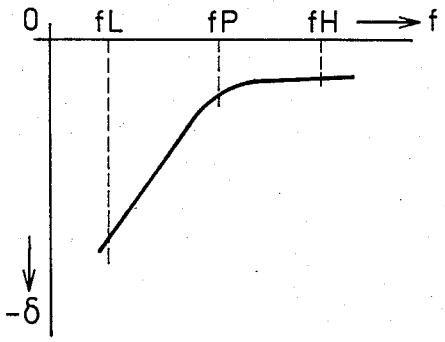
FIG. 4(A) is a graph depicting relative error of the embodiment of FIG. 3.
Figure 4B:
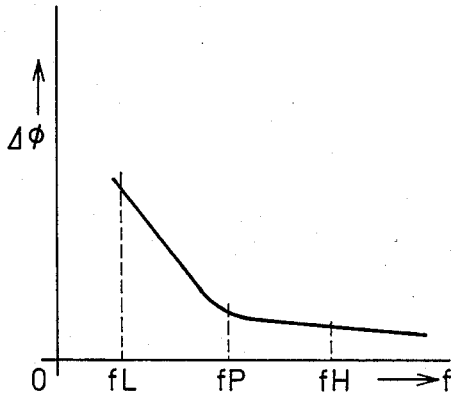
FIG. 4(B) is a graph depicting phase angle error of the embodiment of FIG. 3.

The reason for this situation is that, assuming a frequency fP at which the characteristic changes sharply is the corner frequency, then the loss flowing through the excitation inductance increases abruptly at and below fP. Consequently, the relative error $\delta$ and phase angel error $\Delta\phi$ of the current transformer change in conjunction with the frequency f as shown in FIGS. 4(A) and 4(B), respectively. Both errors become large abruptly at and below the corner frequency fP (and at fL). An operating point may be designed so as to be located in a portion fH above the corner frequency fP. However, if the core loss increases markedly, due to subminiaturization of the current transformer, and if the corner frequency fP exceeds a working frequency (e.g. 50 Hz or 60 Hz), both the relative error $\delta$ and phase angle error $\Delta\phi$ increase as described above. Thus, a high precision, subminiature current transformer cannot be satisfactorily realized.

Figure 5:
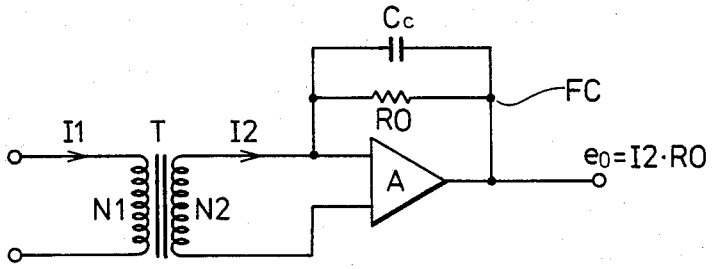
FIG. 5 (PRIOR ART)
FIG. 5 is a circuit diagram depicting a current transformer having a conventional frequency compensating circuit.
Figure 6:
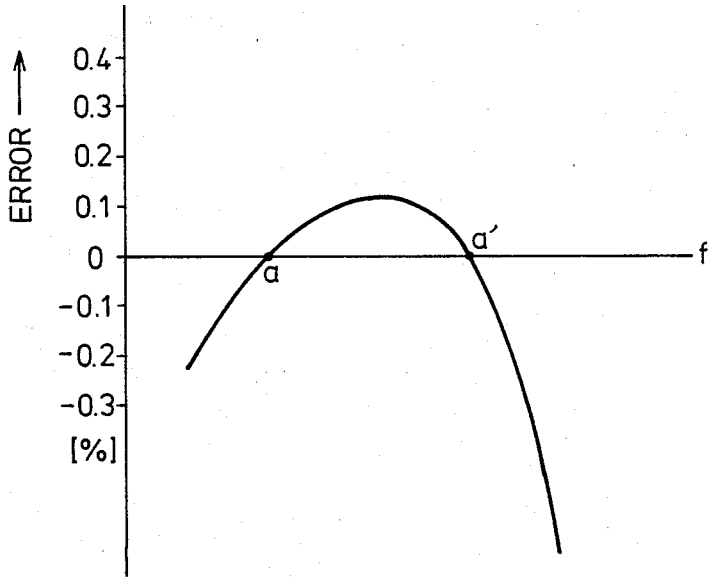
FIG. 6 (PRIOR ART)
FIG. 6 is a graph depicting the frequency characteristics of the circuit of FIG. 5.

In case the corner frequency fP is higher than the working frequency, as shown in FIG. 5, prior current transformers were equipped with a frequency compensating circuit, which compensated for the frequency characteristic by matching phases by use of a capacitor Cc. In FIG. 5, a miniature current transformer T has a primary coil N1, a secondary coil N2, and a frequency compensating circuit FC. Circuit FC comprises an operational amplifier A whose input end is connected to secondary coil N2. Between the input and output terminal of amplifier A is connected a parallel circuit comprising resistor RC and condenser Cc. Frequency compensation is achieved by making the phase of the primary and secondary currents I1 and I2 agree with each other through adjustment of the value of condenser Cc. However, as seen in FIG. 6 (which shows the frequency characteristic of relative error) the conventional compensating circuit FC effects only two points of agreement of phases (namely a, and a') and cannot effectively compensate uniformily over a wide range of frequencies, such as, for example, from 45 Hz to 65 Hz.

The invention has resolved the aforementioned problem of compensating for relative error and phase angle error over a wide range of frequencies. In the invention, a subminiature current transformer is equipped with a circuit capable of compensating for relative error and phase angle error, over a wide range of frequencies. An illustrative embodiment comprising a compensating circuit is depicted in FIG. 7, wherein the same parts as those in FIG. 5 bear the same numerals and designations and will not be repeated in description for sake of simplicity of discussion.

Figure 7:
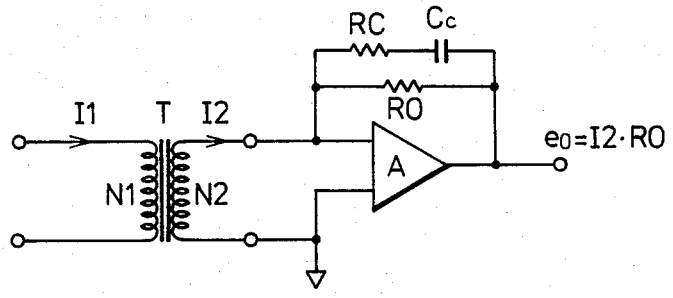
FIG. 7 is a circuit diagram depicting an illustrative embodiment of the invention having a illustrative frequency compensating circuit.
Figure 8:
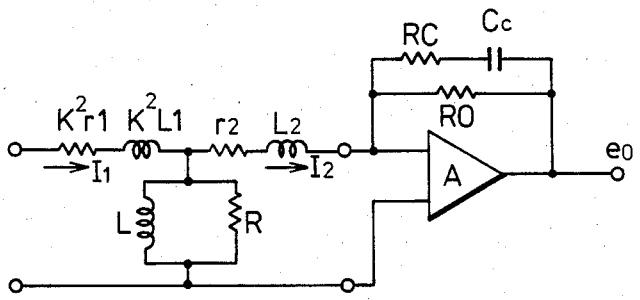
FIG. 8 is an equivalent circuit diagram of the embodiment of FIG. 7.

In FIG. 7 a resistor RC is added in accordance with the invention, and is connected in series with condenser Cc, and the resultant series circuit is connected across resistor RO and between the input and output terminals of operational amplifier A. FIG. 8 is a partial equivalent circuit of the embodiment of FIG. 7, wherein the current transformer is represented by a known equivalent circuit, and wherein reference K indicates a turn ratio of the primary coils N1 and the secondary coils N2. From the output terminal of amplifier A, an output $eo = I2 \cdot RO$ is taken out.

The operation of the current transformer of FIG. 7 will now be described. As the working frequency f increases, for example, as shown in the equivalent circuit of FIG. 8, the impedance of the excitation inductance L of transformer T increases. As a result, the secondary current I2 increases and an increment of the secondary current appears in the form of a frequency error. If the operational amplifier A is operated so that the frequency compensating circuit FC reduces the increment of the secondary current I2, the frequency error can be compensated for.

That is, the foregoing compensation can be achieved by selecting the corner frequency fP of the transformer T, represented by $2\pi L/R$, and the impedance represented by the resistor RC and condenser Cc, connected between the input and output terminals of the amplifier A, so as to satisfy the relationship:

$$2\pi L/R \approx \tfrac{1}{2}\pi Cc \cdot RC \qquad (1)$$

Figure 9:
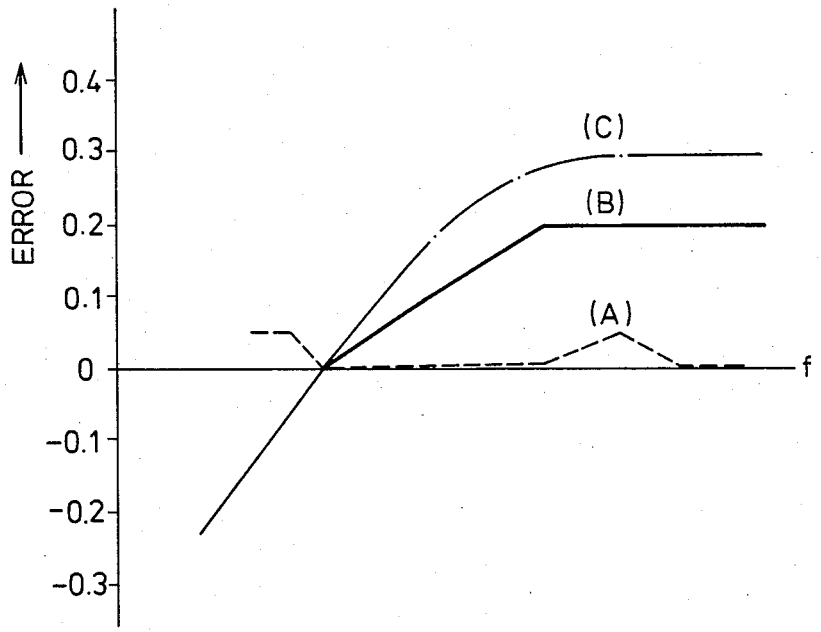
FIG. 9 is a graph depicting the frequency characteristics of the embodiment of FIG. 7.

FIG. 9 shows experimental results of frequency compensation of the transformer T when the corner frequency is made to agree with the impedance. In the experiments, a current transformer T was used, which included a square "O" shaped core of measurements 16×13 mm and a secondary coil N2 of 4,000 turns (because it is a current transformer, the constants of primary coil N1 do not influence the characteristics directly). In FIG. 9, curve (A) represents the frequency characteristic (of relative error) of the case where Cc=0.1 $\mu$F and RC=56 K$\Omega$. Curve (B) represents the frequency characteristic of the case where Cc=0.1 $\mu$F and RC=75 K$\Omega$. Curve (C) represents the frequency characteristics of the case where compensation is not applied. In FIG. 9, the horizontal axis denotes the frequency f, and the vertical axis denotes the frequency error. As shown by Curve (A), according to the invention, compensation for relative error and phase angle error may be effectively applied over a wide range of frequencies by suitably selecting the values of Cc and RC in the FIG. 7 arrangement, so as to agree with the corner frequency fP, as represented by the above equation (1).

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. A current transformer comprising a rectangular "O" shaped core comprising two L-shaped legs connected to each other, said legs being of magnetic material;

a primary coil wound about one L-shaped leg, wherein an area of said one L-shaped leg corresponding to the area in which said primary coil is wound is controlled in size solely by the maximum current desired to be applied to said primary coil;

a secondary coil wound about the other L-shaped leg, wherein an area of said other L-shaped leg corresponding to the area in which said secondary coil is wound is controlled to be as large as possible with respect to the value of current flowing through said secondary coil; and a frequency compensating circuit comprising an operational amplifier having an input terminal and an output terminal, a first resistor connected between the input and output terminals of said operational amplifier, and a series circuit comprising a condenser and a second resistor, connected in parallel with said first resistor;

wherein a corner frequency of said transformer represented by $2\pi L/R$, and impedance determined by said condenser and said second resistor, are selected so as to satisfy the following $$2\pi L/R \approx \tfrac{1}{2}\pi Cc \cdot RC$$

wherein L is an excitation inductance of said current transformer, R is core loss of said current transformer, Cc is the capacitance of said condenser and RC is the resistance of said second resistor.

2. The transformer of claim 1, wherein said one L-shaped leg has a first bobbin of magnetic material thereon, with said primary coil being wound on said first bobbin, and said other L-shaped leg has a second bobbin of magnetic material thereon, with said secondary coil being wound on said second bobbin, and said first and second bobbin being of different shapes.

3. The transformer of claim 1, wherein said primary windings comprise 5 ampere-turns at 5 amps, and said secondary windings comprise 4,000 turns at 1.25 amA.

* * * * *